US007252539B2

(12) United States Patent
Kaoh et al.

(10) Patent No.: US 7,252,539 B2
(45) Date of Patent: Aug. 7, 2007

(54) INSERTION ASSEMBLY OF A KEY MANAGEMENT SYSTEM

(76) Inventors: Andy Kaoh, 235 Chung-Ho Box 8-24, Taipei (TW); Shieh-Hwei Lee Chen, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 11/435,902

(22) Filed: May 18, 2006

(65) Prior Publication Data

US 2006/0264082 A1 Nov. 23, 2006

(30) Foreign Application Priority Data

May 20, 2005 (TW) ..... 94208296 U

(51) Int. Cl.
*H01R 3/00* (2006.01)

(52) U.S. Cl. ..... 439/490; 362/800

(58) Field of Classification Search ..... 439/490, 439/491; 362/800, 100

See application file for complete search history.

(56) References Cited

U.S. PATENT DOCUMENTS 5,634,711 A * 6/1997 Kennedy et al. ..... 362/119
5,673,996 A * 10/1997 Ducker ..... 362/118
6,802,620 B2 * 10/2004 Galli ..... 362/116
2003/0095408 A1 * 5/2003 Opolka ..... 362/241
2004/0170014 A1 * 9/2004 Pritchard et al. ..... 362/202

* cited by examiner

*Primary Examiner*—Phuong Dinh

(57) ABSTRACT

A key management system comprises a sleeve; a plug cover having a part embedded into a rear end of the sleeve; an encoding chip connected to a positive conductive cambered sheet and a negative conductive cambered sheet; an insulating seat having an annular post; a conduit installed at a front side of the insulating seat; a retaining threaded ring installed around an outer periphery of the insulating seat; a front end of the conduit being inserted into the through hole of the retaining threaded ring; an insulating rubber plug installed at a front end of the conduit; a conductive head installed at a front end of the insulating rubber plug; and a conductive rod passing through the positive conductive cambered sheet, the insulating seat, the negative conductive cambered sheet, the conduit, the insulating rubber plug, and the conductive head.

7 Claims, 9 Drawing Sheets

INSERTION ASSEMBLY OF A KEY MANAGEMENT SYSTEM

FIELD OF THE INVENTION

The present invention relates to key management systems, and in particular to an insertion assembly of a key management system, wherein the insertion assembly has an encoding chip which are connected to two contact points of a front end of the insertion assembly and to a light emitting body at a rear end of the light emitting body. When a correct encoding signal is inputted from the two contact points to the insertion assembly, the encoding chip will drive the light emitting body to light up.

BACKGROUND OF THE INVENTION

FIG. 1 shows a prior art AV (audio and video) terminal 1 which includes a ground end, a lift sound channel and a right sound channel. A front end of the insertion terminal 1 is an insertion rod 10 having a three sectional insulating contact surface. The insertion rod 10 is connected to a tube seat 11 at a rear end. The insertion terminal 1 is only used to a connecting joint a microphone or a single AV insertion. It has no other usage. Moreover it is difficult to form the three sectional insulating contact surface and thus the cost is high.

SUMMARY OF THE INVENTION

Accordingly, the primary object of the present invention is to provide an insertion assembly of a key management system, wherein the encoding chip of the insertion unit is connected to a light emitting body so that the distal end of the insertion unit can light up. Furthermore, the light emitting body is a light emitting diode and the plug cover of the insertion unit is a transparent plastic body.

To achieve above objects, the present invention provides An insertion assembly of a key management system which comprises a sleeve having a front opening; an inner side of the sleeve near the front opening having an inner thread; a plug cover having a part embedded into a rear end of the sleeve; the front end of the plug cover being formed with a plurality of hooks to retain the plug cover in the sleeve tightly; an encoding chip connected to a positive conductive cambered sheet and a negative conductive cambered sheet; an insulating seat having an annular post with a reduced size from other portion of the insulating seat; the negative conductive cambered sheet being installed around the annular post; a rear end of the insulating seat being formed with a notch; the positive conductive cambered sheet being installed in the notch; a conduit installed at a front side of the insulating seat; the conduit having a through hole; a retaining threaded ring installed around an outer periphery of the insulating seat; the retaining threaded ring having a through hole at a center portion thereof; a front end of the conduit being inserted into the through hole of the retaining threaded ring; an outer thread of the retaining threaded ring being screwed to the inner thread of the sleeve; an insulating rubber plug installed at a front end of the conduit; the insulating rubber plug having a through hole; a conductive head installed at a front end of the insulating rubber plug; the conductive head having a through hole; and a conductive rod passing through the positive conductive cambered sheet, the insulating seat, the negative conductive cambered sheet, the through hole of the conduit, the through hole of the insulating rubber plug, and the through hole of the conductive head; an inner periphery of the conductive rod being spaced from an inner periphery of the conduit.

The various objects and advantages of the present invention will be more readily understood from the following detailed description when read in conjunction with the appended drawing.

DETAILED DESCRIPTION OF THE INVENTION

Figure 1:
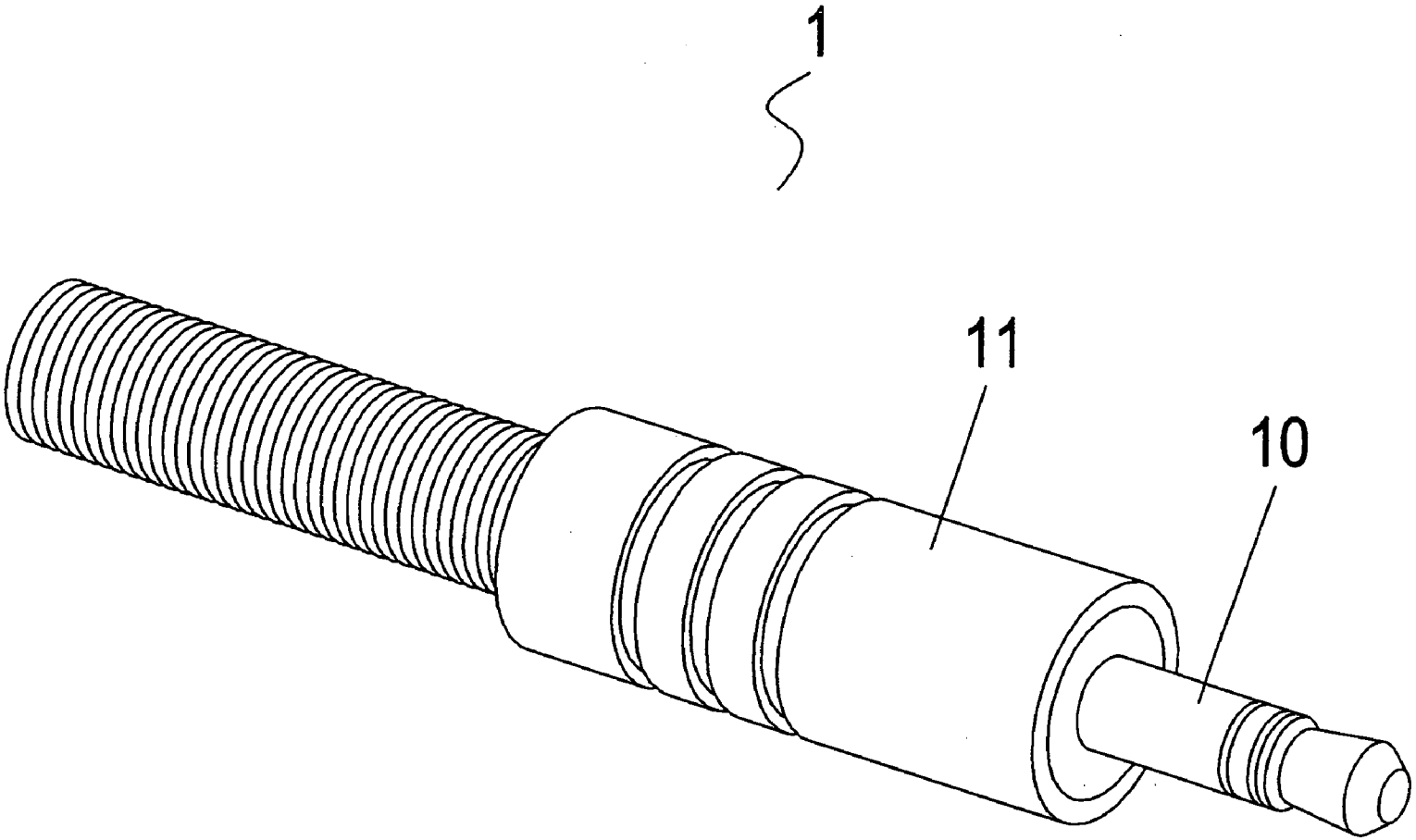
Fig.1 (PRIOR ART)
FIG. 1 is a structural schematic view of a prior art insertion assembly.
Figure 2:
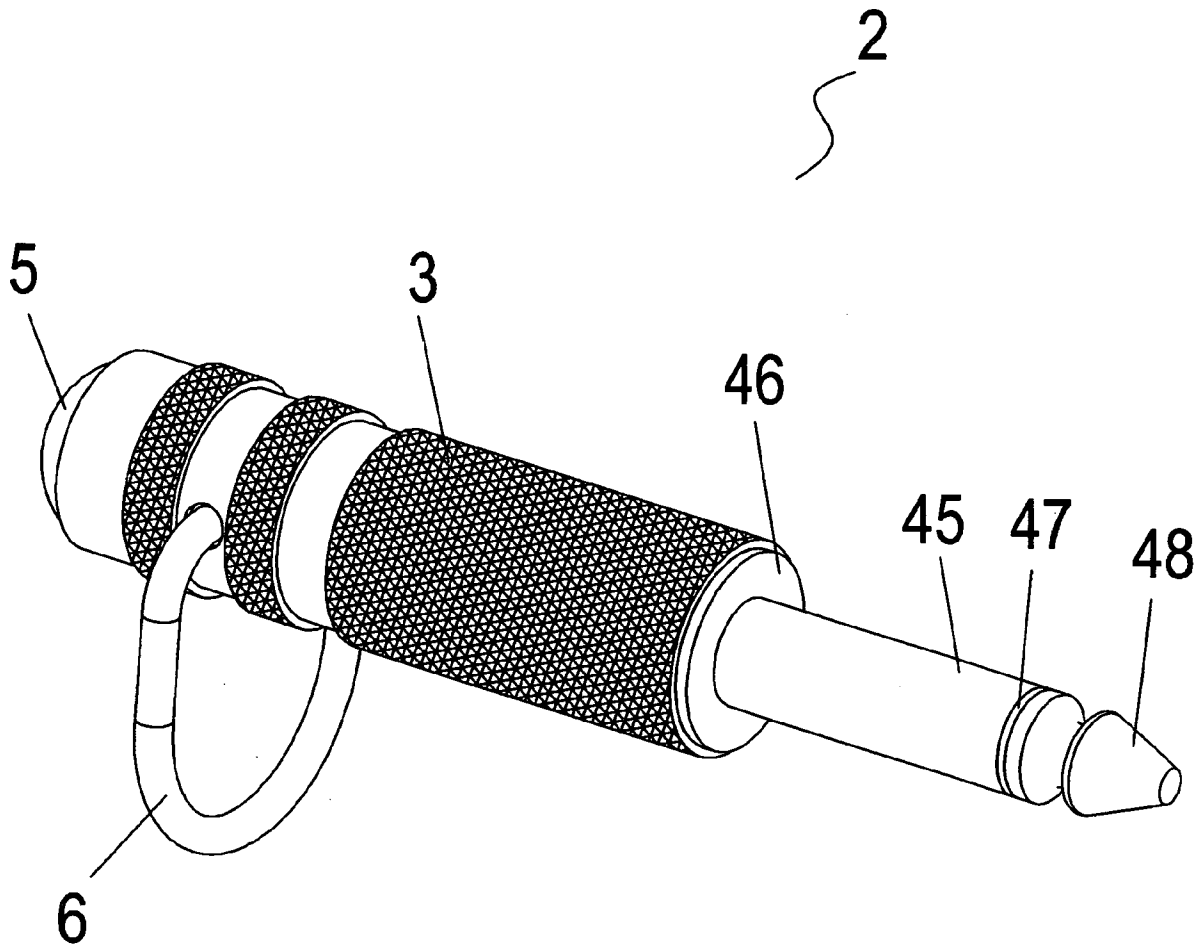
FIG. 2 is a perspective view of the present invention.
Figure 3:
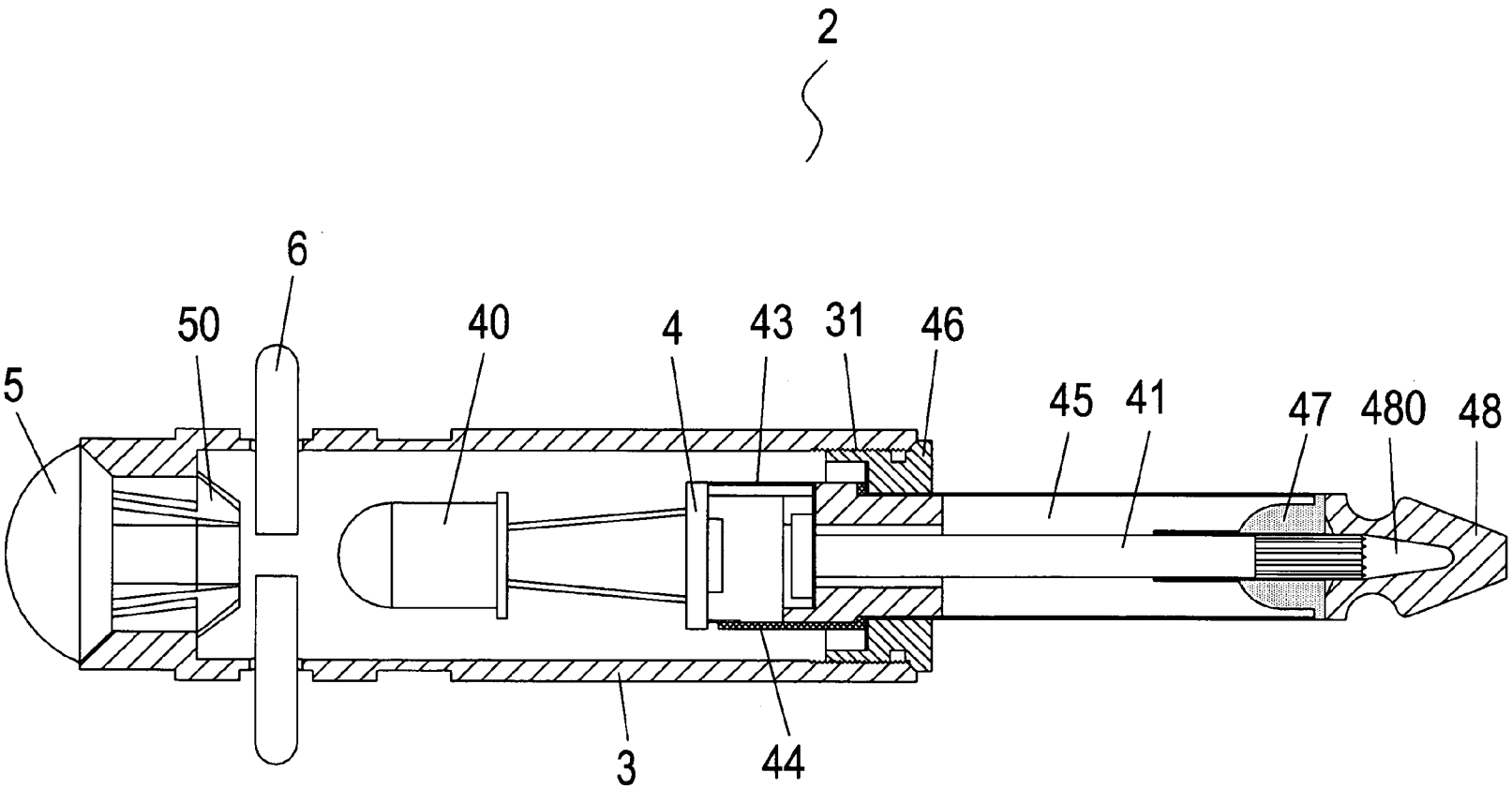
FIG. 3 is an assembled cross sectional view of the present invention.
Figure 4:
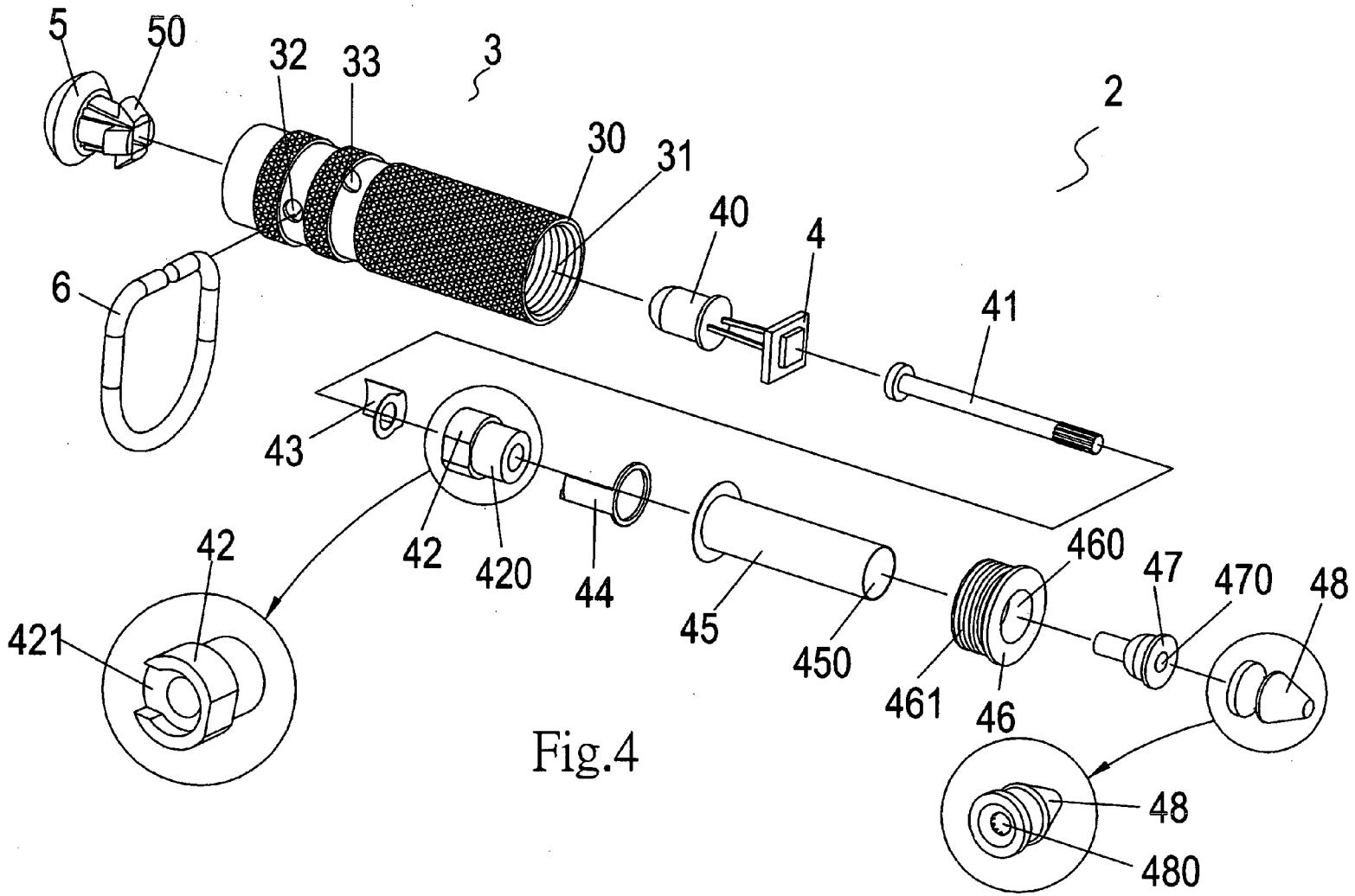
FIG. 4 is an exploded perspective view of the present invention.
Figure 5:
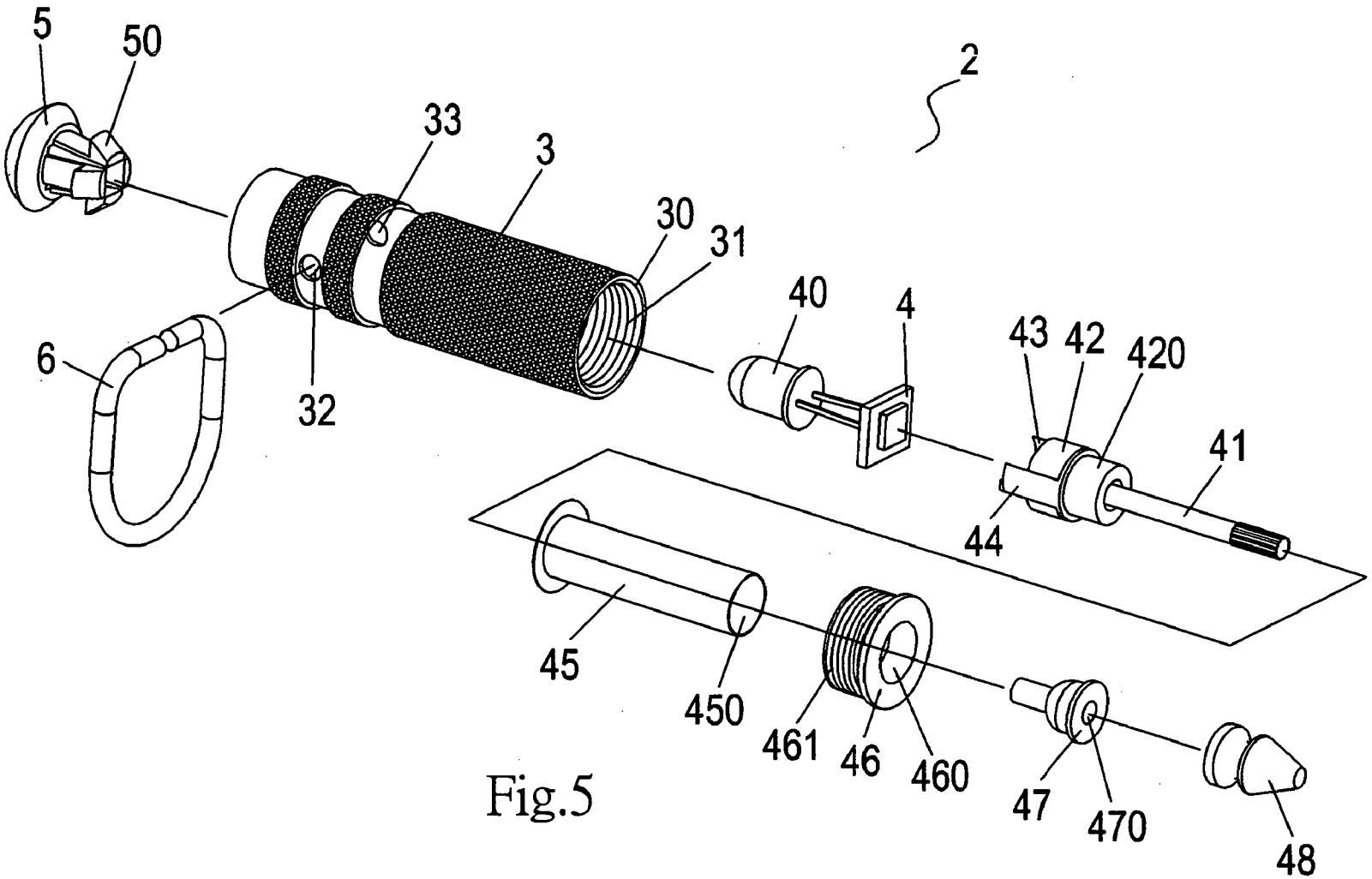
FIG. 5 is an exploded perspective view of the present invention, wherein partial components are assembled.
Figure 6:
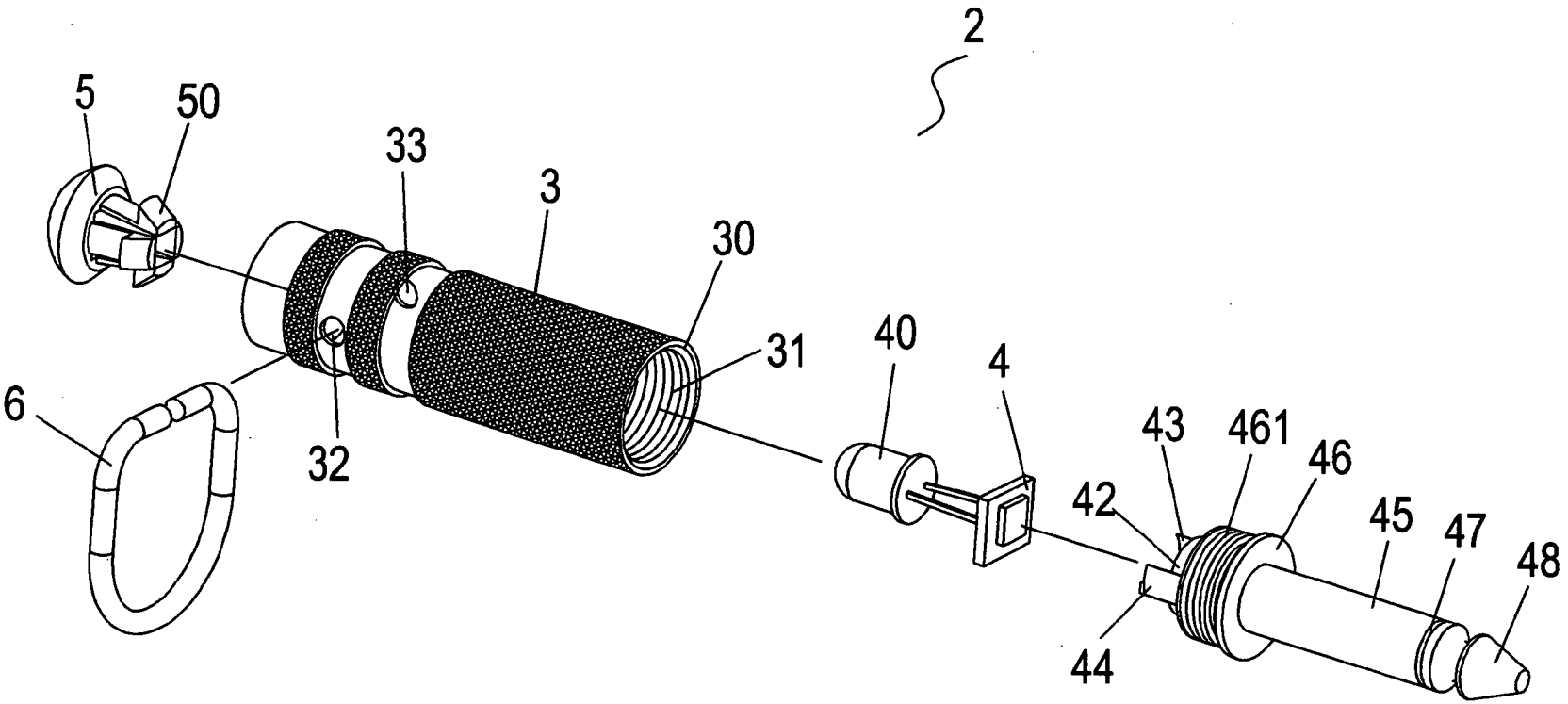
FIG. 6 is another exploded perspective view of the present invention, wherein partial components are assembled.
Figure 7:
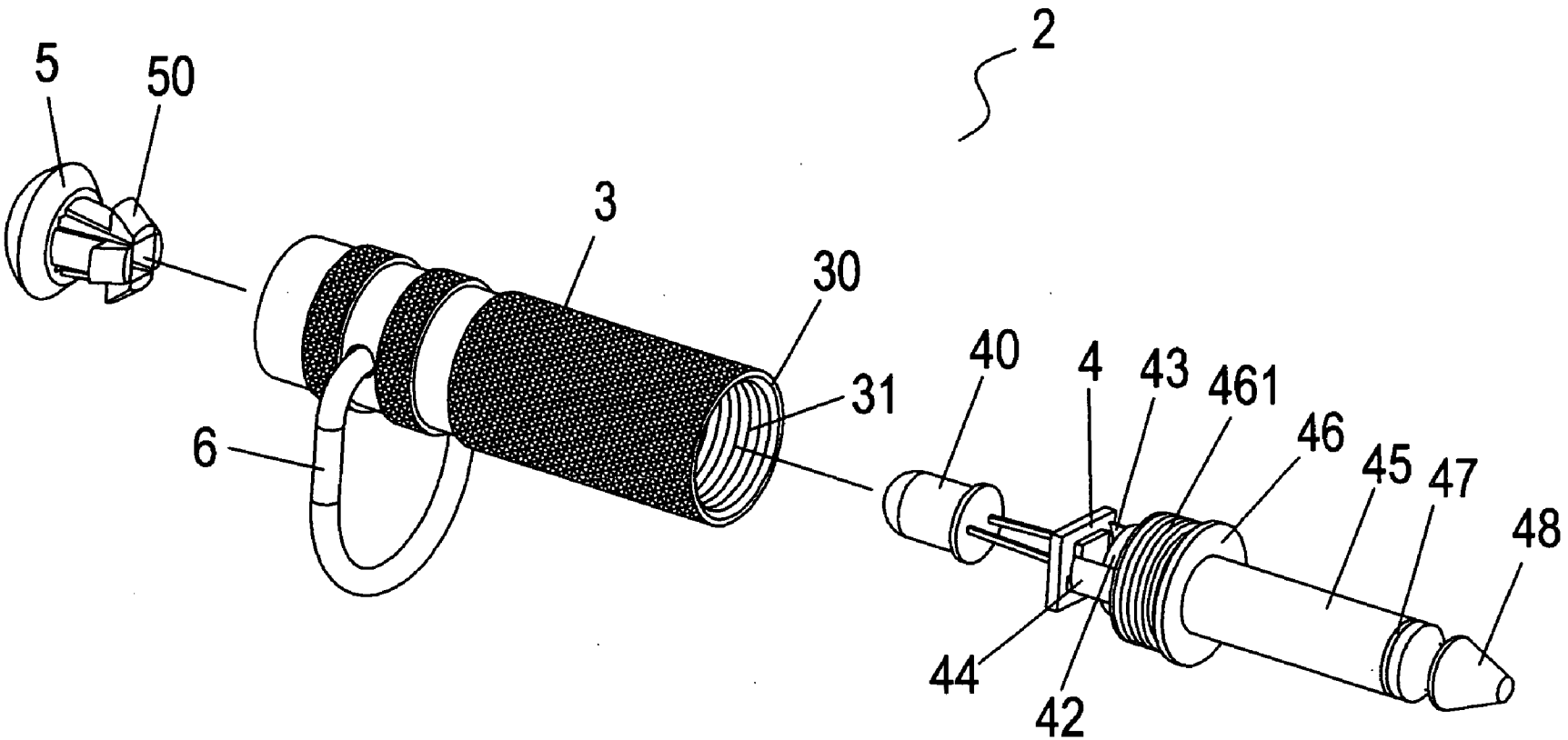
FIG. 7 is a further exploded perspective view of the present invention, wherein partial components are assembled.
Figure 8:
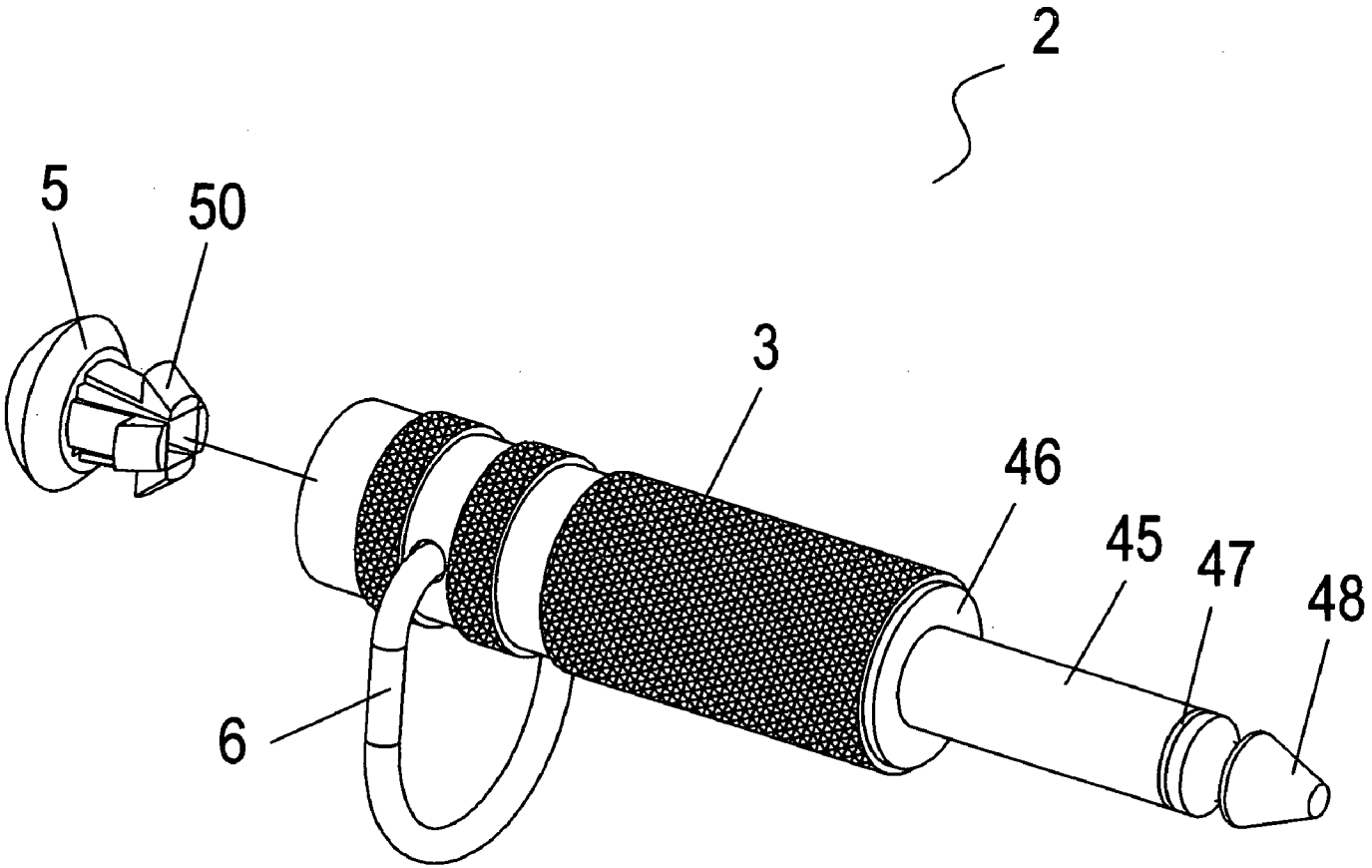
FIG. 8 is an assembled view of the present invention.

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Referring to FIGS. 2 to 8, a lock insertion assembly used in a key manage system according to the present invention is illustrated. An insertion unit 2 has the following elements.

A sleeve 3 is has a front opening 30. An inner side of the sleeve 3 near the front opening 30 has an inner thread 31. An outer periphery of the sleeve 3 is textured. An outer side of the sleeve 3 has two locking holes 32, 33 for locking a toggle 6.

A plug cover 5 has a part embedded into a rear end of the sleeve 3. The front end of the plug cover 5 is formed with a plurality of hooks 50 which are arranged with a cruciform so as to retain the plug cover 5 in the sleeve 3 tightly.

An encoding chip 4 is included. The encoding chip 4 is connected to a positive conductive cambered sheet 43 and a negative conductive cambered sheet 44.

A light emitting body 40 extends from a rear end of the encoding chip 4.

An insulating seat 42 has an annular post 420 with a reduced size from other portion of the insulating seat 42. The negative conductive cambered sheet 44 is installed around the annular post 420. A rear end of the insulating seat 42 is formed with a notch 421. The positive conductive cambered sheet 43 is installed in the notch 421.

A conduit 45 is at a front side of the insulating seat 42. The conduit 45 has a through hole 450.

A retaining threaded ring 46 is installed around an outer periphery of the insulating seat 42. The retaining threaded ring 46 has a through hole 460 at a center portion thereof. A front end of the conduit 45 is inserted into the through hole 460 of the retaining threaded ring 46. An outer thread 461 of the retaining threaded ring 46 is screwed into the inner thread 31 of the sleeve 3.

An insulating rubber plug 47 is installed at a front end of the conduit 45. The insulating rubber plug 47 has a through hole 470.

A conductive head 48 is installed at a front end of the insulating rubber plug 47. The conductive head 48 has a through hole 480.

A conductive rod 41 passes through the positive conductive cambered sheet 43, the insulating seat 42, the negative conductive cambered sheet 44, the through hole 450 of the conduit 45, the through hole 470 of the insulating rubber plug 47, and the through hole 480 of the conductive head 48. An inner periphery of the conductive rod 41 is spaced from an inner periphery of the conduit 45.

Furthermore, the light emitting body is a light emitting diode and the plug cover of the insertion unit is a transparent plastic body.

Figure 9:
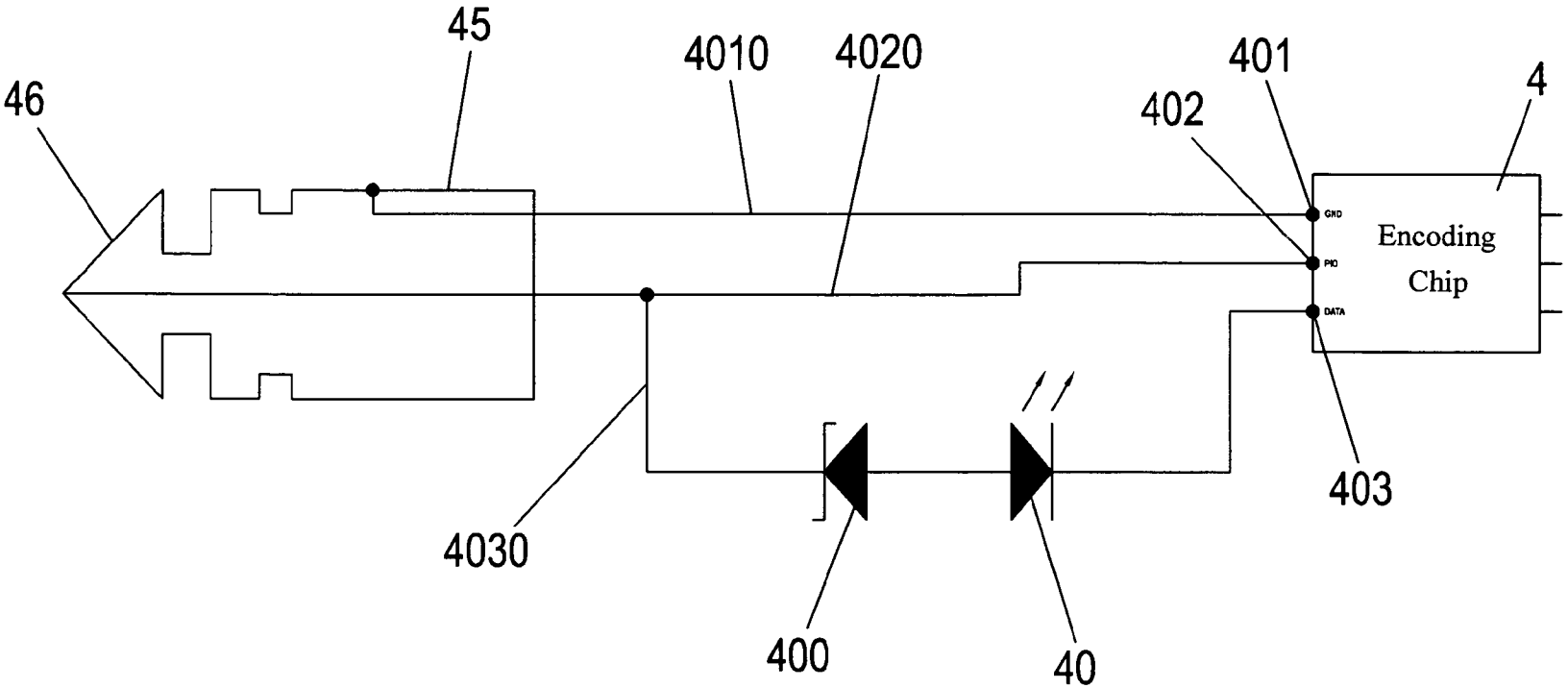
FIG. 9 shows the circuit connection of the present invention.

Referring to FIG. 9, a two wire and two sectional communication design is disclosed. A first pin 401 of the encoding chip 4 is connected to an inner wall of the conduit 45 through a ground wire 4010. The second pin 402 of the encoding chip 4 is connected to an inner wall of the retaining threaded ring 46 through a signal wire 4020. The third pin 403 of the encoding chip 4 is electrically connected to a negative electrode of the light emitting body 40 through a date wire 4030. The positive electrode of the light emitting body 40 is connected to a positive electrode of a Zener diode 400 in series. A negative electrode of the Zener diode 400 is electrically connected to the date wire 4030 so as to be as a two wire data transmission.

Advantages of the present invention will be described herein. The insertion unit 2 has an encoding chip 4 for identification through the coding. The light from the distal end of the insertion unit 2 is transmitted through the cover plug to display to users. The insertion unit 2 is installed with the encoding chip 4 to prevent the key is reproduced. The size of the present invention is compact and portable conveniently. The present invention is used to advanced identification technology. It is improved and practical.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An insertion assembly of a key management system comprising:

a sleeve having a front opening; an inner side of the sleeve near the front opening having an inner thread;

a plug cover having a part embedded into a rear end of the sleeve; the front end of the plug cover being formed with a plurality of hooks to retain the plug cover in the sleeve tightly;

an encoding chip connected to a positive conductive cambered sheet and a negative conductive cambered sheet;

an insulating seat having an annular post with a reduced size from other portion of the insulating seat; the negative conductive cambered sheet being installed around the annular post; a rear end of the insulating seat being formed with a notch; the positive conductive cambered sheet being installed in the notch;

a conduit installed at a front side of the insulating seat; the conduit having a through hole;

a retaining threaded ring installed around an outer periphery of the insulating seat; the retaining threaded ring having a through hole at a center portion thereof; a front end of the conduit being inserted into the through hole of the retaining threaded ring; an outer thread of the retaining threaded ring being screwed to the inner thread of the sleeve;

an insulating rubber plug installed at a front end of the conduit; the insulating rubber plug having a through hole;

a conductive head installed at a front end of the insulating rubber plug; the conductive head having a through hole; and a conductive rod passing through the positive conductive cambered sheet, the insulating seat, the negative conductive cambered sheet, the through hole of the conduit, the through hole of the insulating rubber plug, and the through hole of the conductive head; an inner periphery of the conductive rod being spaced from an inner periphery of the conduit.

2. The insertion assembly of a key management system as claimed in claim 1, wherein a light emitting body extends from a rear end of the encoding chip.

3. The insertion assembly of a key management system as claimed in claim 1, wherein the plurality of hooks are arranged with a cruciform.

4. The insertion assembly of a key management system as claimed in claim 1, wherein an outer side of the sleeve having two locking holes for locking a toggle.

5. The insertion assembly of a key management system as claimed in claim 1, wherein the plug cover is a transparent plastic body.

6. The insertion assembly of a key management system as claimed in claim 1, wherein an outer periphery of the sleeve is textured.

7. The insertion assembly of a key management system as claimed in claim 1, wherein a first pin of the encoding chip is connected to an inner wall of the conduit through a ground wire; a second pin of the encoding chip is connected to an inner wall of the retaining threaded ring through a signal wire; a third pin of the encoding chip is electrically connected to a negative electrode of the light emitting body through a date wire; a positive electrode of the light emitting body is connected to a positive electrode of a Zener diode in series and a negative electrode of the Zener diode is electrically connected to a date wire so as to be as a two wire data transmission.

* * * * *